US012466617B2

(12) United States Patent
Taylor et al.

(10) Patent No.: US 12,466,617 B2
(45) Date of Patent: Nov. 11, 2025

(54) ALL-PLASTIC POURING SPOUT AND CLOSURE ASSEMBLY

(71) Applicant: Greif International Holding BV, Amstelveen (NL)

(72) Inventors: Dale Taylor, Delaware, OH (US); Pedro Miguel De Oliveira, Delaware, OH (US)

(73) Assignee: Greif International Holding BV, Amstelveen (NL)

( * ) Notice: Subject to any disclaimer, the term of this patent is extended or adjusted under 35 U.S.C. 154(b) by 166 days.

(21) Appl. No.: 18/532,415

(22) Filed: Dec. 7, 2023

(65) Prior Publication Data

US 2024/0199288 A1 Jun. 20, 2024

Related U.S. Application Data

(60) Provisional application No. 63/433,940, filed on Dec. 20, 2022.

(51) Int. Cl.

| | |
|---|---|
| ***B65D 47/06*** | (2006.01) |
| ***B65D 41/34*** | (2006.01) |
| ***B65D 41/46*** | (2006.01) |

(52) U.S. Cl.

CPC ..... *B65D 47/063* (2013.01); *B65D 41/3409* (2013.01); *B65D 41/46* (2013.01)

(58) Field of Classification Search

CPC .. B65D 47/063; B65D 41/3409; B65D 41/46; B65D 2401/50; B65D 47/123

See application file for complete search history.

(56) References Cited

U.S. PATENT DOCUMENTS

| | | | |
|---|---|---|---|
| 5,641,099 | A | 6/1997 | McLelland et al. |
| 5,788,100 | A | 8/1998 | Sturk |

(Continued)

FOREIGN PATENT DOCUMENTS

| | | | |
|---|---|---|---|
| EP | 0320808 | A1 | 6/1989 |
| WO | 2009105855 | A1 | 9/2009 |

OTHER PUBLICATIONS

Extended European Search Report mailed Apr. 25, 2024 by the European Patent Office for counterpart European Patent Application No. 23217369.0.

*Primary Examiner* — Vishal Pancholi
(74) *Attorney, Agent, or Firm* — Armstrong Teasdale LLP

(57) ABSTRACT

A securing ring is snap-fittingly engageable over and around an annular mounting flange of a foldable pouring spout in a container closure assembly, with a frangible connection between the securing ring and a spout closure member (e.g. a screw cap) intact. The assembled closure assembly is snap-fittingly engageable over and around a container neck which is received in a groove extending circumferentially about the mounting flange. The groove is defined in part by a radially outer wall having a proximal portion lying towards the pouring end of the spout and a distal end portion lying away from the pouring end of the spout. The radially outer wall comprises a central flexure zone of reduced radial width relative to the proximal and distal end portions, whereby the distal end portion is hingeingly deflectable between a radially outer position for extraction of the spout from a mold tool, and a radially inner position for engagement in an annular undercut in a radially outer surface of the container neck. When the securing ring is snap-fittingly engaged over and around the mounting flange, the distal end portion is held in the radially inner position. The distal end portion comprises a chamfer at its radially inner side and which extends radially inwards towards the pouring end of the (Continued)

spout for guiding the closure assembly into snap-fitting engagement with the container neck.

20 Claims, 7 Drawing Sheets

(56) References Cited

U.S. PATENT DOCUMENTS

| | | | |
|---|---|---|---|
| 5,797,525 | A | 8/1998 | Mclelland et al. |
| 5,967,376 | A | 10/1999 | McLelland et al. |
| 2014/0299569 | A1 | 10/2014 | Van de Klippe et al. |

ALL-PLASTIC POURING SPOUT AND CLOSURE ASSEMBLY

FIELD OF THE INVENTION

The present invention concerns a container closure assembly which incorporates a foldable pouring spout through which contents of the container are dispensed.

BACKGROUND OF THE INVENTION

These foldable pouring spouts are usually made from a flexible plastics material such as LDPE. They are typically formed separately from the rest of the container and are fitted to a filling and dispensing neck of the container at the container filling line. From then on, the spout is intended to remain permanently secured to the neck during the rest of the container's usage. The folded pouring spout is typically supplied to the container filler (packaged goods supplier) as part of an assembly which further includes a removable and reclosable cap, lid or stopper. The closure assembly will normally incorporate tamper evidencing (TE) features which are broken or otherwise irreversibly visibly changed the first time that the spout is unfolded (extended) and/or the first time that the closure cap etc. is removed from the assembly. Intact TE features thus provide the consumer with some assurance that the container contents have not been interfered with in the supply chain. These pouring spout and closure assemblies may be applied to suitable filling and dispensing necks on any type or style of container or container component—e.g., steel drums, pails, cans, and their lids; blow-molded plastics barrels, cans, and bottles; injection-molded barrel and pail lids and covers; among others.

Current foldable pouring spouts are typically crimped on to the container filling and dispensing neck with metal retainers that can rust and may not be easily recyclable with the rest of a container, such as a plastic pail. Other offerings that are all-plastic can be tampered with and removed, thus allowing the container contents to be compromised, resulting in brand owner dissatisfaction. Historically brand owners have been sensitive to the level of tamper evidence provided by the container that packages their products. Container content pilfering or tampering could result in a large claim against the company. Providing tamper evident solutions over the years has evolved from metal crimp ring affixed pouring spouts that had a tear away plastic retainer between the crimp ring and the cap, to an all-plastic press-in pouring spout assembly that provided improved recyclability while providing a degree of tamper evidence and pry-off resistance: see U.S. Pat. Nos. 5,641,099A and 5,788,100A. Albeit with some difficulty, it is nevertheless possible to pry these pouring spout assemblies off the dispensing neck without noticeable damage. A patient person with the necessary know-how could surreptitiously remove these spouts and replace them, which is potentially a problem for brand owners. According to both of these patents, an annular, upstanding filling and dispensing neck has a substantially cylindrical inner surface defining a container opening. An upper, outer edge of the neck is configured with a radially outwardly extending lip portion and a recessed area underneath the lip portion which is used for interlocking and snap-fit engagement with the all-plastic closure. The fixed end of the pouring spout includes an outer flange with annular inner and outer walls which are joined by an upper wall and which together define an inverted annular channel. A lip extends radially inwards from a bottom edge portion of the outer wall so as to enter the recessed area underneath the radially outwardly extending lip portion of the neck and help form the snap-fit engagement. In U.S. Pat. No. 5,641,099A an outer ring is united with a spout closing cap by a plurality of frangible elements. The outer ring is assembled onto and around the outer flange of the pouring spout and the thus assembled ring and flange are together snap-fitted onto the upstanding filling and dispensing neck. To enable the outer wall of the outer flange to be stripped from its mold tool without undue difficulty, the radially inwardly extending lip of the outer wall is of small cross-section, with a small axial depth. To enable the spout and closure assembly to be press-fitted onto the filling and dispensing neck with sufficiently low an axial force to minimise risk of the frangible elements breaking, the cross-section of the outer ring must also be kept sufficiently small. The small cross-sections of the radially inwardly extending lip of the outer wall and of the outer ring make the ring and flange assembly vulnerable to being pried off the filling and dispensing neck without visible damage or breakage of the frangible elements. A similar arrangement is used in U.S. Pat. No. 5,788,100A, except that the outer flange of the pouring spout is first fitted to the filling and dispensing neck with the outer ring held above the outer flange by the frangible elements which connect it to the spout closing cap. The outer ring is then pressed downwards over and around the outer flange, breaking the frangible elements in the process. This causes the entire outer wall of the outer flange to hinge slightly inward about its connection to the outer flange top wall, pressing the outer wall into tight sealing engagement with the filling and dispensing neck. Because by design there are then no intact frangible elements between the outer ring and the spout closing cap, the outer ring may be made more robust, with a thicker cross-section compared to the outer ring of U.S. Pat. No. 5,641,099A. The outer ring of U.S. Pat. No. 5,788,100A may therefore have an increased pry-off resistance. However, because the outer ring lacks any anti-amper features, it is nevertheless still vulnerable to pry-off and replacement without visible damage to the closure assembly.

U.S. Pat. No. 5,967,376A and WO2009/105855A1 concern spouts that are insert molded to a pail cover during the cover molding operation. These insert molded pouring spouts have not achieved extensive commercial acceptance due to very high capital costs for robotic insertion equipment.

SUMMARY OF THE INVENTION

The present invention provides a container closure assembly comprising:

- a foldable pouring spout of plastics material having a first end providing a dispensing aperture and a second end provided with an annular mounting flange configured for mounting the foldable pouring spout on a container neck; and
- a closure member of plastics material removably sealingly engageable across the dispensing aperture to selectively allow or prevent dispensing of container contents through the dispensing aperture;
- wherein the closure member is integrally formed with a securing ring which is attached to the closure member by a frangible connection;
- the securing ring being snap-fittingly engageable over and around the mounting flange with the frangible connection intact and the thus assembled closure assembly being snap-fittingly engageable over and around the container neck;

a groove extending circumferentially about the annular mounting flange and which is open in an axial direction opposite to the first end of the foldable pouring spout for reception of the container neck in such snap-fitting engagement;

wherein the circumferentially extending, axially open groove is defined in part by a radially outer wall having a proximal portion lying towards the first end of the foldable pouring spout and a distal end portion lying away from the first end of the foldable pouring spout;

the radially outer wall comprising a central flexure zone of reduced radial width relative to the proximal and distal end portions and which interconnects the proximal and the distal end portions, whereby the distal end portion is hingeingly deflectable relative to the proximal portion, between a radially outer position for extraction of the foldable pouring spout from a mold tool, and a radially inner position for engagement in an annular undercut in a radially outer surface of the container neck;

wherein when the securing ring is snap-fittingly engaged over and around the mounting flange, the distal end portion is held in the radially inner position;

and wherein the distal end portion of the radially outer wall comprises a chamfer at its radially inner side and which extends radially inwards towards the first end of the foldable pouring spout for guiding the closure assembly into snap-fitting engagement with the container neck. The distal end portion may therefore be molded in (or moved to) the radially outer position to ease the extraction of the foldable pouring spout from the mold tool. When the pouring spout and closure member are assembled, the distal end portion of the radially outer wall is held in the radially inner position. This decreases the slope of the chamfer on the inner side of the distal end portion measured relative to the axis along which the pouring spout and closure member assembly is pressed onto the container neck. This increases the mechanical advantage and reduces the pressing force required to achieve snap-fitting engagement of the radially outer wall's distal end portion in the annular undercut in the radially outer surface of the container neck. The securing ring may therefore be made more robust, e.g. having a larger cross section than would otherwise be possible, without risk of the frangible connection breaking during application of the closure assembly to the container neck. The more robust securing ring is more resistant to pry-off attempts and is more likely to show visible damage as a result of such pry-off attempts. Because the central flexure zone allows the distal end portion of the radially outer wall to be molded in the radially outer position or easily moved to that position as the foldable pouring spout is stripped from the mold, the distal end portion may be elongated in axial cross-section, which in turn allows a further decrease in the slope of the chamfer, a further increase in its mechanical advantage, and a further reduction in the pressing force required to snap-fit the assembled closure assembly to the container neck.

A first axial end of the securing ring may be connected to the closure member by the frangible connection. The frangible connection may for example comprise a plurality of frangible bridges distributed at intervals around the circumference of the securing ring. Each frangible bridge may extend generally radially between the securing ring and the closure member. These bridges are easily broken when it is desired to extend the pouring spout and remove the closure member for the first time, for dispensing the container contents. This provides a clear visible indication that the container contents may have been accessed. Some or all of the frangible bridges may also be broken to leave a visible indication if an attempt is made to pry off the securing ring. Additionally, or alternatively, the frangible connection may comprise a rupturable membrane. This provides tamper-evidencing functions similar to the frangible bridges but may also provide an uninterrupted surface between the securing ring and closure member for reception of printed graphics, adhesive labels and the like. The membrane may also shield the region that it covers against ingress of dirt, water or like contaminants from the surrounding environment.

A second axial end of the securing ring remote from the frangible connection may define an entrance through which the mounting flange passes as the securing ring is snap-fittingly engaged over and around it; the entrance comprising a radially inwardly extending protrusion which provides the snap-fit engagement between the securing ring and the mounting flange.

A rim of a side of the mounting flange which faces towards the first end of the foldable pouring spout may comprise a chamfer for guiding the mounting flange through the entrance and for compressing the mounting flange and/or expanding the securing ring as the mounting flange is pressed past the radially inwardly extending protrusion to provide the snap-fit engagement between the securing ring and the mounting flange.

A shoulder may be formed at an end of the radially outer wall's proximal portion adjacent to the central flexure zone, and the radially inwardly extending protrusion may be configured to engage behind this shoulder when the securing ring is snap-fittingly engaged over and around the mounting flange.

The radially inwardly extending protrusion may also hold the distal end portion of the radially outer wall in the radially inner position when the securing ring is snap-fittingly engaged over and around the mounting flange.

With the securing ring snap-fittingly engaged over and around the mounting flange, co-operating surfaces of the radially inwardly extending protrusion and the distal end portion of the radially outer wall may be configured to contact each other at a generally annular region that lies axially inward, toward the first end of the foldable pouring spout, relative to an annular region of the radially outer wall that makes initial contact with the container neck as the container closure assembly is pushed onto it. This allows the distal end portion of the radially outer wall to act as a lever which can provide a mechanical advantage for expanding the securing ring, thereby reducing the force required to snap the container closure assembly onto the container neck.

With the securing ring snap-fittingly engaged over and around the mounting flange, co-operating surfaces of the radially inwardly extending protrusion and the distal end portion of the radially outer wall may be configured to contact each other at a generally annular region, wherein one or both of the co-operating surfaces is curved in axial cross-section, so as to provide at least a degree of rolling contact therebetween as the container closure assembly is snapped onto the container neck. This may serve to reduce frictional forces, and hence the force required to snap the container closure assembly onto the container neck.

With the container closure assembly snapped onto the container neck, the securing ring may be configured to provide an enhanced interference fit between the container neck and an annular sealing land within the mounting flange's circumferential groove.

With the container closure assembly snapped onto the container neck, the radially outer wall's distal end portion and central flexure zone and the radially inwardly extending protrusion of the securing ring may be configured to press an annular sealing land within the mounting flange's circumferential groove into tighter sealing engagement with the container neck.

At its axial side opposite to the first end of the pouring spout when snap-fitted over and around the mounting flange, the securing ring may comprise an annular tamper-evidencing lip of reduced thickness. The tamper-evidencing lip may be designed to be visibly damaged if an attempt is made to insert a pry-off tool between the securing ring and the body of the container, with the aim of prying the closure assembly off the container neck.

With the pouring spout in its folded position and the securing ring snap-fittingly engaged over and around the mounting flange, the closure member may be configured to extend radially so as to cover the pouring spout from the mounting flange inward. The pouring spout (especially its vulnerable recessed folded region) is therefore shielded against environmental dirt/water accumulation. An annular sealing lip may be provided on at least one of the pouring spout or closure member, which is engageable with the other of the closure member or pouring spout, to improve such shielding.

The circumferentially extending, axially open groove of the mounting flange may be defined in part by a radially inner wall configured to extend through the container neck when the container closure assembly has been snap-fitted onto the container neck. A distal portion of the radially inner wall may extend beyond the container neck and comprise a radially outer bead to assist in securing the container closure assembly to the container neck. The inner wall distal portion may be radially apertured so that the container contents may be substantially fully drained through the container neck by inversion of the container, without pooling around the inner wall distal portion.

The closure member may comprise at least one integrally formed, movably connected bail handle e.g., connected to the remainder of the closure member by a living hinge. The bail handle may comprise a lift tab received in a recess formed in the axial side of the securing ring adjacent to the pouring spout first end when the bail handle is in a stowed (lowered) position; the lift tab then extending radially at least partly through the recess, whereby the bail handle may be easily grasped and lifted to raised position for extending the pouring spout and removing the closure member from the pouring spout's first end.

Herein, the term "container" is to be construed as including components of a container, such as a container lid or cover.

The invention and some of its optional features and advantages is further explained below with reference to illustrative embodiments shown in the drawings.

DETAILED DESCRIPTION OF ILLUSTRATIVE EMBODIMENTS

Figure 1:
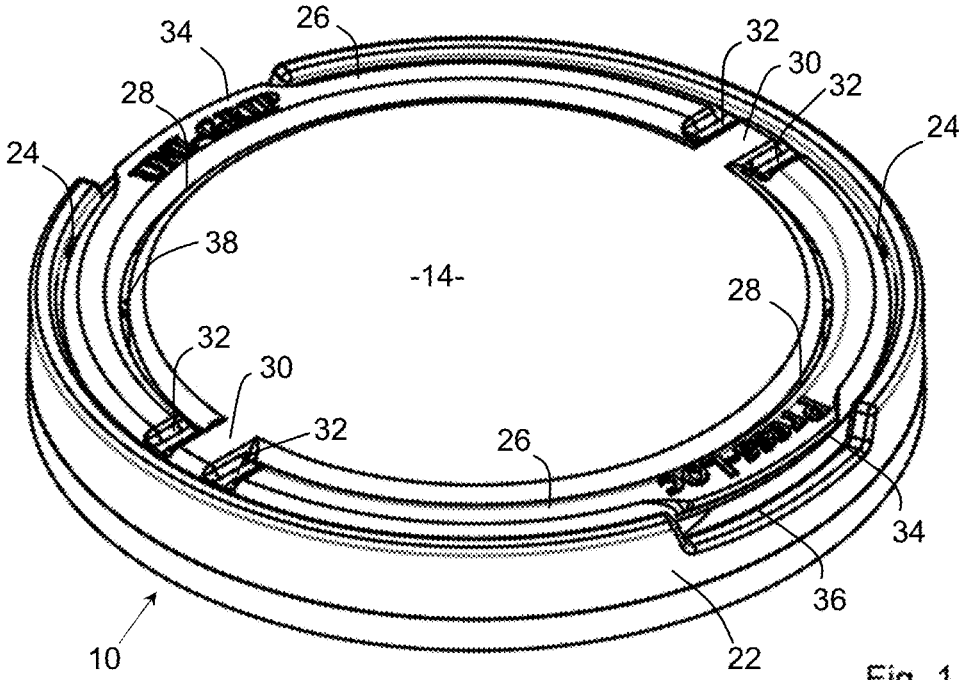
FIGS. 1-3 are respective top perspective, top plan, and front side views of a unitary cap and securing ring molding, useable in an embodiment of the present invention.
Figure 2:
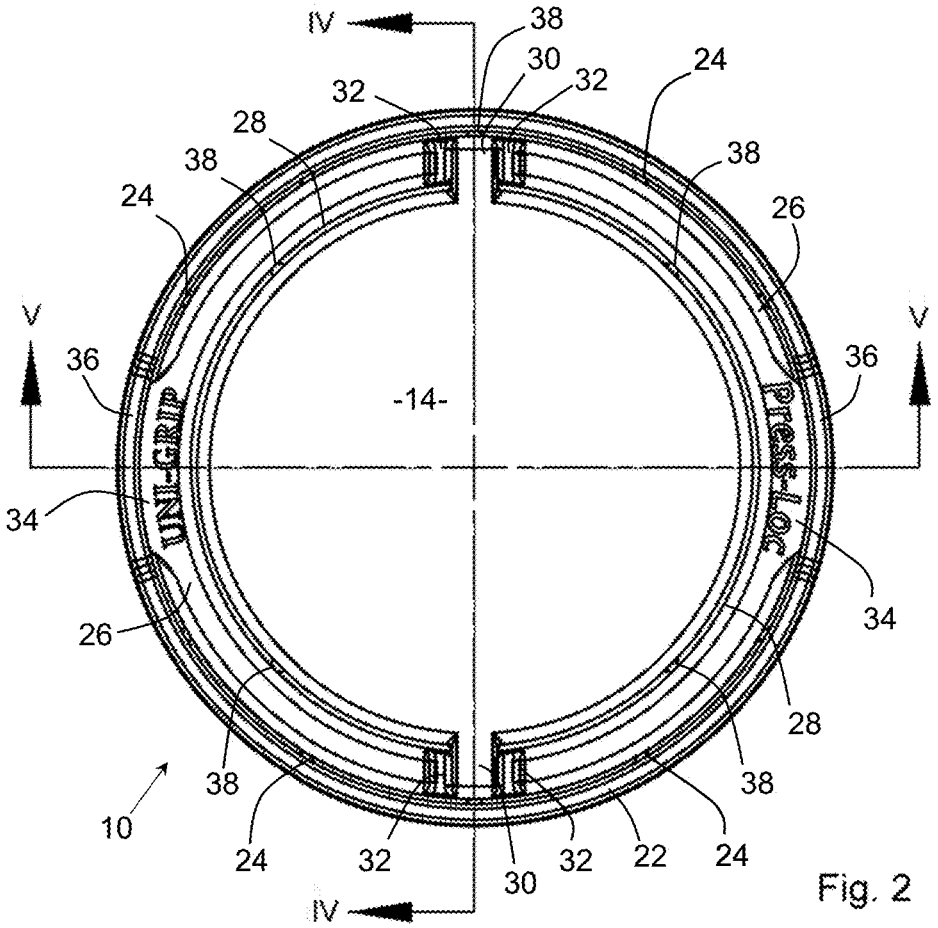
Figure 3:
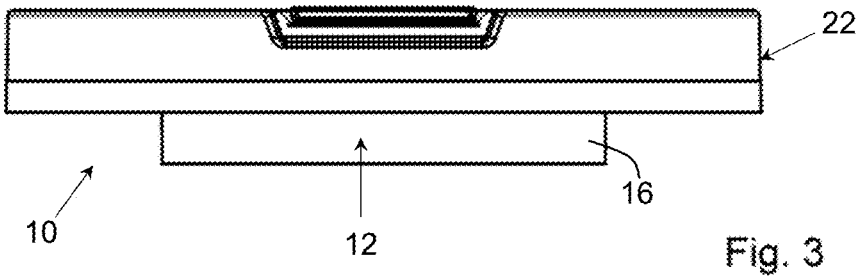
Figure 4:
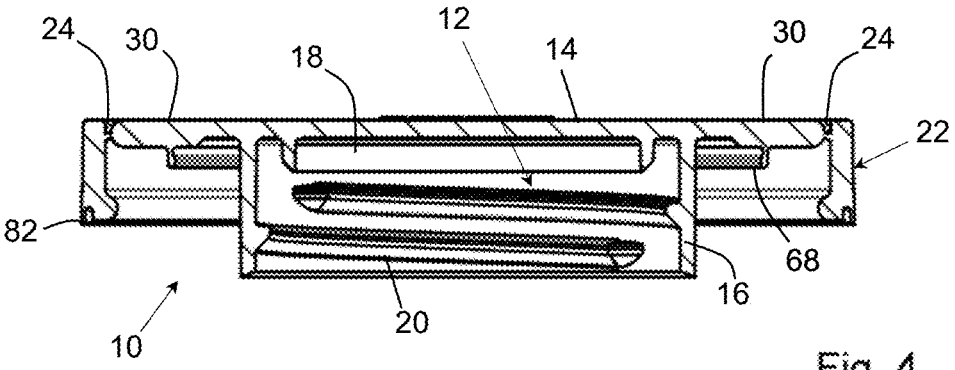
FIGS. 4 and 5 are respective cross-sectional views on lines IV-IV and V-V in FIG. 2.
Figure 5:
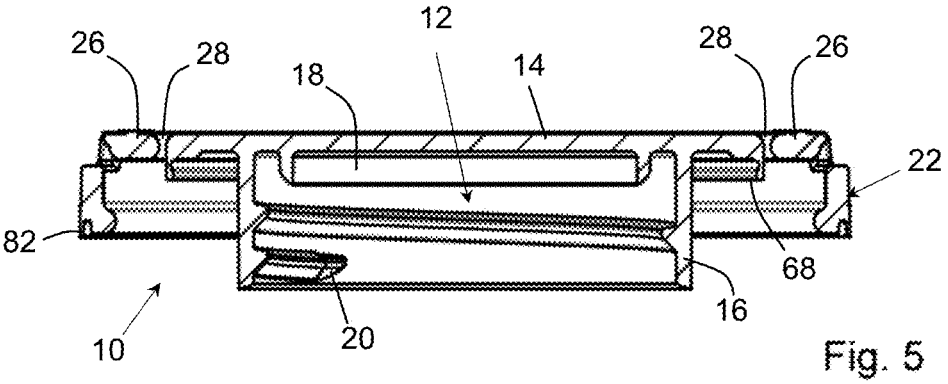
Figure 6:
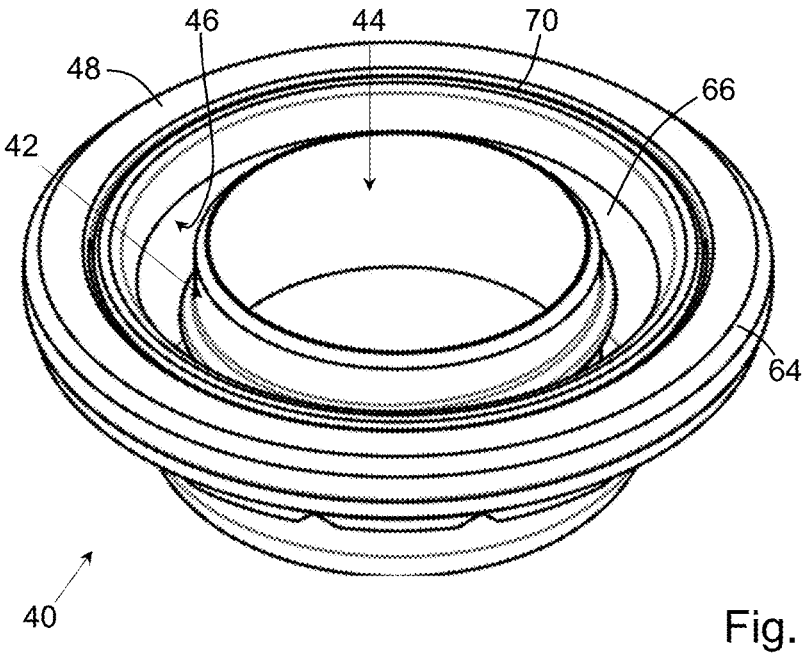
FIGS. 6-9 are respective top perspective, top plan, underplan, and front side views of a foldable pouring spout for use in conjunction with the cap and securing ring of the preceding FIGS., to form a container closure assembly embodying the present invention.
Figure 7:
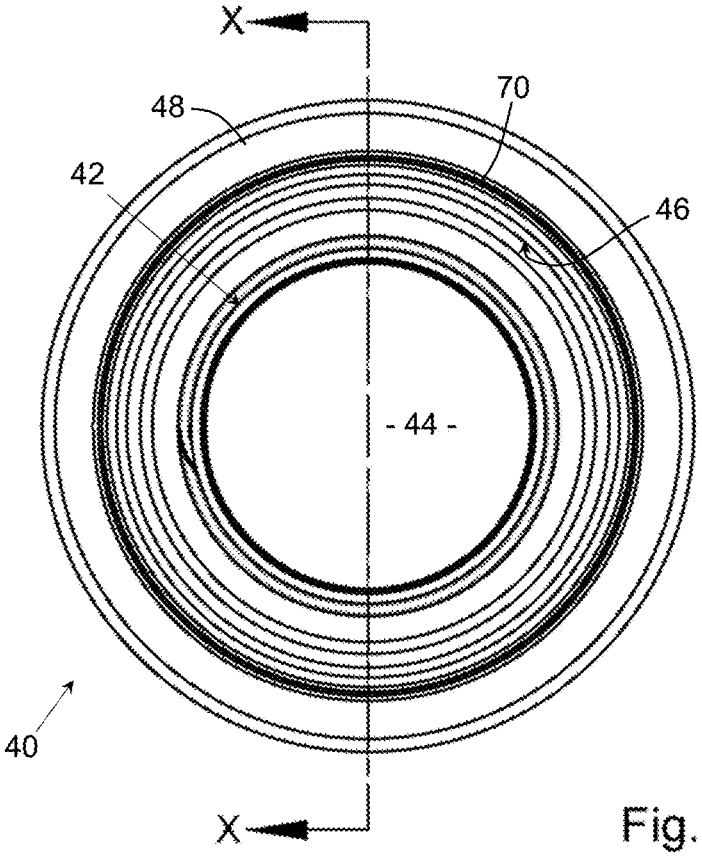
Figure 8:
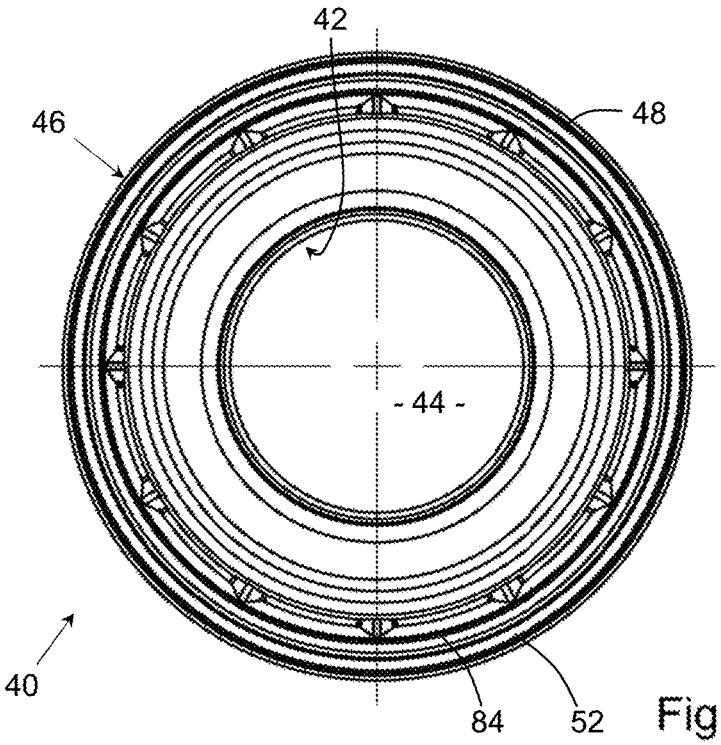
Figure 9:
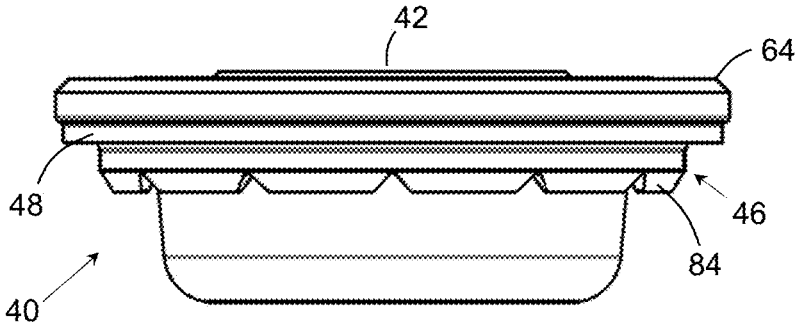
Figure 10:
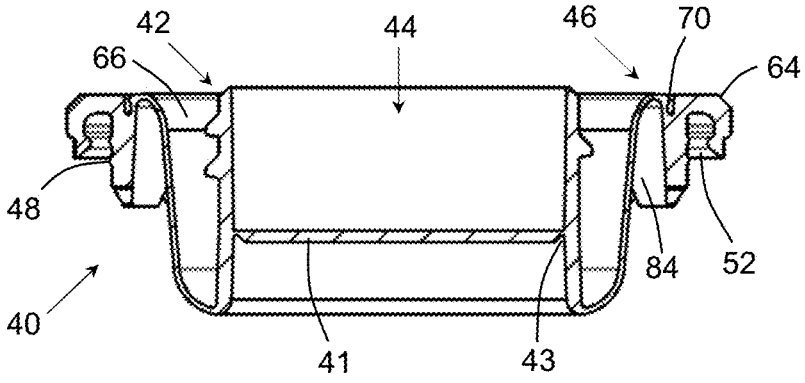
FIG. 10 is a cross-sectional view on line X-X in FIG. 7.

The unitary spout closure member 12 and securing ring 22 shown in FIGS. 1-5 may be a one-piece injection molding 10 formed from a suitable plastics material, such as HDPE. The spout closure member 12 may take any suitable form, such as an internal plug, external cap, or a combination of these. It may be secured to removably and replaceably seal across the dispensing aperture at the first (extensible or pouring) end of the foldable pouring spout in any suitable manner, for example using a press fit, snap fit, or screw threaded connection. The spout closure member 12 shown by way of illustrative example in the drawings is a screw cap, having a top wall 14 and a generally cylindrical side wall 16 which depends from the top wall 14. An annular lip 18 depends from the top wall concentrically within the side wall 16, to form a plug seal, sealingly engageable within the open first end of the foldable pouring spout. The side wall 16 has an internal thread 20 which can be screwed on and off a complementary external screw thread formed on the foldable pouring spout at or adjacent to the first end thereof. The securing ring 22 is attached to the spout closure member 12 by any suitable frangible connection 24. This for example may be a tearable web linking the rim of the closure member top wall 14 to the upper axial side of the securing ring 22, so as to provide the closure member/securing ring combination 12, 22 with a substantially continuous upper surface. This may assist in shielding the foldable pouring spout and container neck below against contamination by dirt, water and the like from the environment. It may also assist in providing a large uninterrupted area on the prominent upper face of the closure member/securing ring combination 12, 22 for reception of printed graphics, labels and the like. Additionally, or alternatively and as shown in the illustrative drawings, the frangible connection between the securing ring 22 and the spout closure member 12 may comprise a plurality of frangible bridges 24 which may be circumferentially distributed about the securing ring 22 and may extend between the rim of the top wall 14 of the spout closure member 12 and a region at or near to an upper inner edge of the securing ring 22.

The closure member 12 may comprise at least one integrally formed bail handle connected to it by a living hinge. For example, the illustrative drawings show a pair of bail handles 26 formed at the outer circumference of the top wall 14. Each bail handle 26 is delineated from the remainder of the top wall 14 by an arcuate slot 28. A pair of diametral extensions 30 of the top wall 14 are uninterrupted by the slots 28. These extensions form mountings to which ends of each bail handle 26 are connected by living hinges 32. The frangible connections 24 therefore interconnect the bail handles 26 and the securing ring 22. Each bail handle has a centrally positioned lift tab 34 which, in the as-molded condition of the unitary molding 10 comprising the spout closure member 12 and securing ring 22, extends radially into a recess 36 provided in the upper axial end face of the securing ring 22. The recess 36 therefore houses the lift tab 34 when the corresponding bail handle is in its lowered position. It therefore provides the lift tab with a degree of protection against accidental knocks, which could otherwise cause premature breakage of the frangible connections 24. The lift tabs are sufficiently spaced from the surrounding parts of the securing ring to nevertheless remain readily finger-accessible by the end user, so that they can be grasped to raise the bail handles 26 when required, e.g., even when the user is encumbered by wearing protective gloves. Additional frangible connections 38 may be provided between the bail handles 26 and the remainder of the closure member top wall 14, e.g., spanning the arcuate slots 28. Although the illustrative drawings show the frangible connections 38 in the form of frangible bridges, any suitable frangible connection may be used—for example, a rupturable membrane to maintain a substantially continuous upper surface of the closure member top wall 14, resulting in the same advantages as previously discussed in relation to the frangible connections 24. Lifting the bail handles 26 therefore breaks the frangible connections 24 (and the frangible connections 38, if present), allowing the foldable pouring spout to be pulled out and extended, by virtue of the closure member still being sealingly fitted and mechanically connected to the first end of the foldable pouring spout at this time, as further explained later.

The illustrative foldable pouring spout 40 of FIGS. 6-14 is shown in its as-molded, folded condition. It may be injection molded from a relatively soft, flexible plastics material, such as LDPE. It has a first end 42 providing a dispensing aperture 44, and a second end 46 provided with an annular mounting flange 48 configured for mounting the foldable pouring spout 40 on a container neck 50 (see FIGS. 12 and 14-16).

The closure member 12 is removably sealingly engageable across the dispensing aperture 44 to selectively allow or prevent dispensing of container contents therethrough. The closure member 12 and securing ring 22 comprising the unitary molding 10 can be assembled together with the foldable pouring spout 40 by the manufacturer, to form closure assemblies 10, 40 for delivery to a container filler. The closure assemblies 10, 40 may then be used by the container filer to close and seal the filled containers at the filling line. The closure assemblies 10, 40 are made by snap-fitting the securing ring 22 over and around the mounting flange 48 with the frangible connection 24 intact. Where a (right handed) screw thread connection 20 is used to secure the closure member 12 to the pouring spout first end 42 across the dispensing aperture 44 (as shown by way of example in the illustrative drawings), automated equipment can be used to press mounting flange 48 into the securing ring 22, while also rotating the closure member/securing ring unitary molding 10 clockwise relative to the folded pouring spout 40, when viewed from the unitary molding-side. In this way, the closure member 12 can be screwed fully onto the pouring spout first end 42, so that the assemblies are delivered to the container filler in a fully closed condition, ready to seal the containers. The equipment may simultaneously engage the securing ring 22 and the closure member 12 (e.g. via the recesses 36 and the diametral extensions 30 respectively) to prevent any relative co-axial rotation, thereby relieving any shear forces on the frangible connection 24. The thus assembled closure assembly 10, 40 can then be snap-fitted over and around the container neck 50 by the container filler. The frangible connections 24 and the retaining ring 22 thereby serve to retain the spout 40 in its folded, retracted configuration during shipping; preventing the spout 40 and cap 12 from popping up, should there be a rise in pressure within the container or a reduction in ambient pressure, e.g. during air transportation. To provide an additional fluid seal and tamper indicating means, a tear-out diaphragm 41 (FIG. 10) may be integrally molded within the pouring spout 40, extending across the dispensing aperture 44. The diaphragm 41 is equipped with a suitable tab, pull ring or the like (not shown), allowing it to be torn out of the spout 40 by rupturing a peripheral membranous connection 43.

Figure 11:
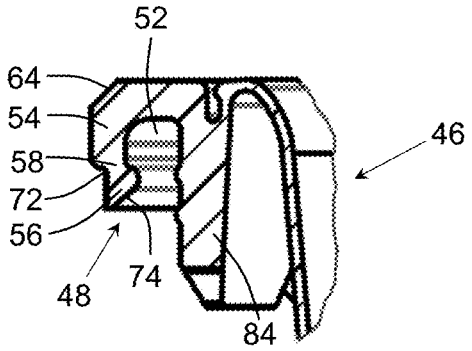
FIG. 11 is an enlarged view of a portion of FIG. 10.
Figure 12A:
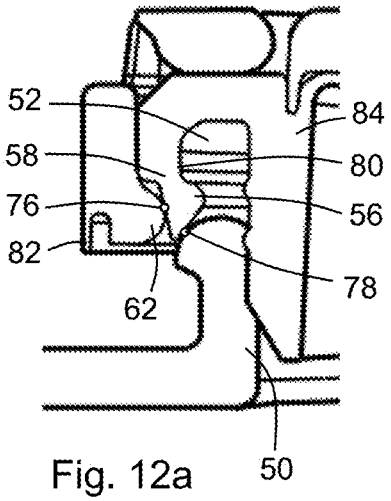
FIG. 12*a* is an enlarged view of a portion of FIG. 12.
Figure 12:
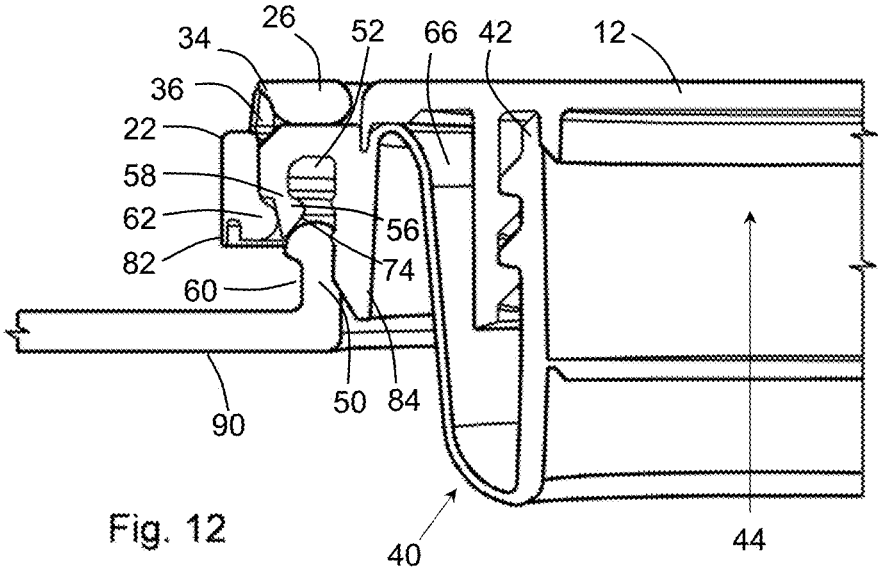
FIG. 12 is a scrap cross-sectional view showing the cap, securing ring and spout of the preceding FIGS. preassembled and being offered up for snap-fit engagement with a container neck.
Figure 13:
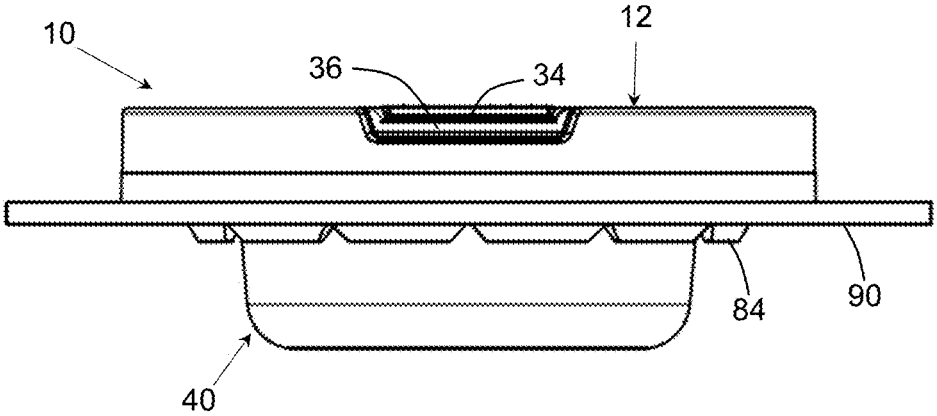
FIGS. 13 and 14 are respective front (or back), and left (or right) side views of the container closure assembly of the preceding FIGS., shown snap-fitted to a portion of a container lid.
Figure 14:
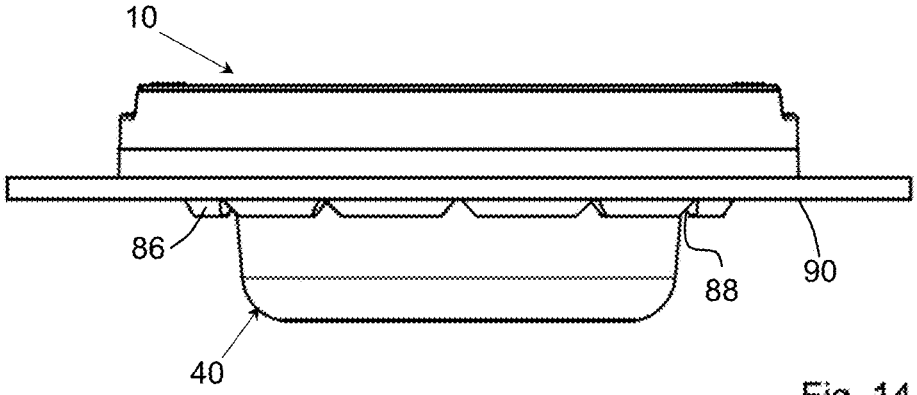
Figure 15:
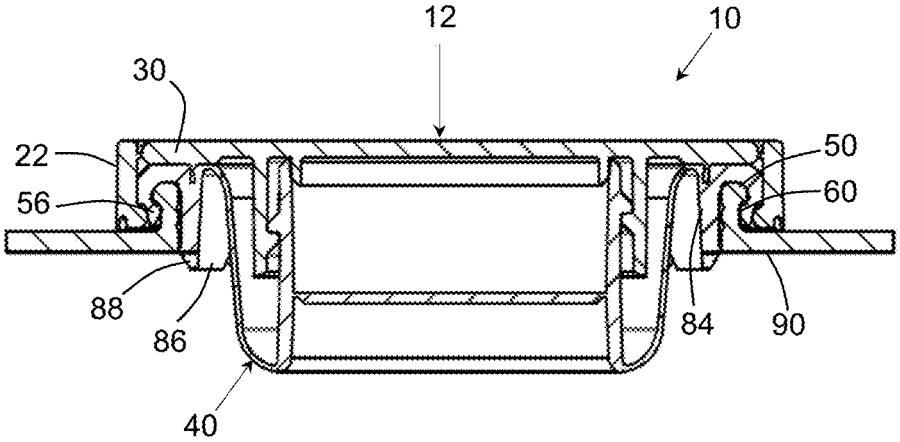
FIGS. 15 and 16 are diametral cross-sectional views corresponding to FIGS. 13 and 14 respectively.
Figure 16:
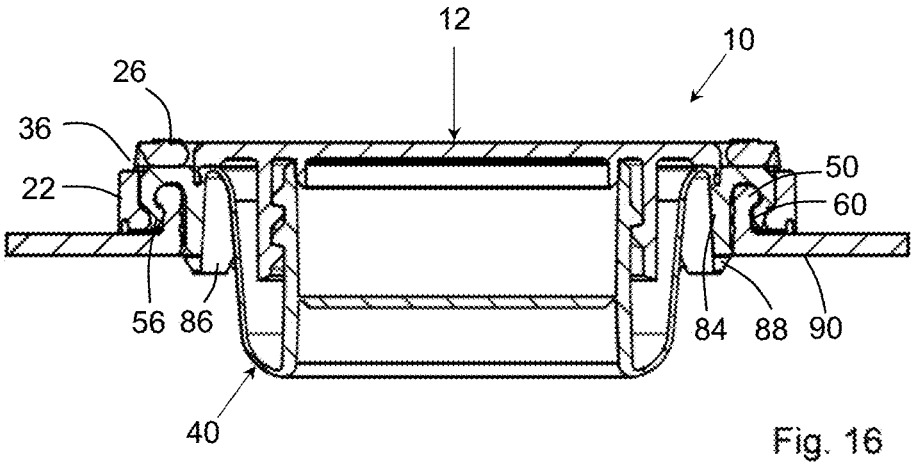

A groove 52 is provided extending circumferentially about the annular mounting flange 48 and which is open in an axial direction opposite to the first end 46 of the foldable pouring spout 40 for reception of the container neck 50 in such snap-fitting engagement. The groove 52 is defined in part by a radially outer wall having a proximal portion 54 lying towards the first end 42 of the foldable pouring spout and a distal end portion 56 lying away from the first end 42 of the foldable pouring spout. As best seen in FIGS. 11 and 12, the radially outer wall comprises a central flexure zone 58 of reduced radial width relative to the proximal 54 and distal 56 end portions and which interconnects these end portions, whereby the distal end portion 56 is hingeingly deflectable relative to the proximal portion 54, between a radially outer position for extraction of the foldable pouring spout from a mold tool, and a radially inner position for engagement in an annular undercut 60 in a radially outer surface of the container neck 50. When the securing ring 22 is snap-fittingly engaged over and around the mounting flange 48, the distal end portion 56 is held in the radially inner position. As shown in the illustrative drawings, the lower axial end of the securing ring 22 remote from the frangible connection 24 may define an entrance through which the mounting flange 48 passes as the securing ring 22 is snap-fittingly engaged over and around it; the entrance comprising a radially inwardly extending protrusion 62 which provides the snap-fit engagement between the securing ring 22 and the mounting flange 48. A rim of the side of the mounting flange 48 which faces towards the first end 42 of the foldable pouring spout 40 may comprise a chamfer 64 for guiding the mounting flange through the entrance and for compressing the mounting flange 48 and/or expanding the securing ring 22 as the mounting flange 48 is pressed past the radially inwardly extending protrusion 62 to provide the snap-fit engagement between the securing ring and the mounting flange. Because the mounting flange 48 is usually of a relatively soft and flexible material and is not supported by the container neck 50 prior to fitment thereto, the mounting flange 48 is easily compressed to snap-fit past the radially extending protrusion 62, prior to fitment of the closure assembly 10, 40 to the container neck 50. Pre-assembly of the closure assembly 10, 40 may therefore be achieved using relatively low axial compressive force. When the pouring spout 40 is in its folded position and the securing ring 22 is snap-fittingly engaged over and around the mounting flange 48, the closure member top wall 14 may extend radially so as to cover the pouring spout 40 from the mounting flange 48 inward. The pouring spout 40 (especially its vulnerable recessed folded region 66) can in this way be shielded against environmental dirt/water accumulation. In the illustrative example, to improve such shielding, an annular sealing lip 68 is shown provided on the closure member 12, which is engageable with a complementary circumferential groove 70 formed at a suitable position in the pouring spout 40, e.g. in the upper face of the mounting flange 48. The positions of these components 68, 70 may be reversed as regards the pouring spout and mounting flange.

To hold the components 10, 40 of the closure assembly together in snap-fitted engagement, a shoulder 72 may be formed at an end of the radially outer wall's proximal portion 56 adjacent to the central flexure zone 58, and the radially inwardly extending protrusion 62 may be configured to engage behind this shoulder when the securing ring 22 is snap-fittingly engaged over and around the mounting flange 48. The distal end portion 56 of the radially outer wall comprises a chamfer 74 at its radially inner side and which extends radially inwards towards the first end 42 of the foldable pouring spout 40 for guiding the closure assembly 10, 40 into snap-fitting engagement with the container neck 50. The distal end portion 56 may therefore be molded in (or moved to) the radially outer position to ease the extraction of the foldable pouring spout 40 from the mold tool. When the pouring spout 40 and closure member molding 10 are assembled together, the distal end portion 56 of the radially outer wall is held in the radially inner position. This decreases the slope of the chamfer 74 on the inner side of the distal end portion measured relative to the axis along which the pouring spout and closure member assembly is pressed onto the container neck. (Compare FIGS. 11 and 12, for example. These show a deflection of the distal end portion 56 of about fifteen degrees. This however is not critical to the invention and other deflections will allow effective reduction in required mold stripping forces on the one hand and closure assembly application forces on the other hand, as may be readily calculated or experimentally determined). The decreased slope increases the mechanical advantage and reduces the pressing force required to achieve snap-fitting engagement of the radially outer wall's distal end portion 56 in the annular undercut 60 in the radially outer surface of the container neck 50. The securing ring 22 may therefore be made more robust, e.g., having a larger cross section than would otherwise be possible, without risk of the frangible connection 24 breaking during application of the closure assembly 10, 40 to the container neck 50. The more robust securing ring 22 is more resistant to pry-off attempts and is more likely to show visible damage as a result of such pry-off attempts. Because the central flexure zone 58 allows the distal end portion 56 of the radially outer wall to be molded in the radially outer position or easily moved to that position as the foldable pouring spout 40 is stripped from the mold, the distal end portion 56 may be elongated in cross-section without leading to demoulding problems; which in turn allows a further decrease in the slope of the chamfer 74, a further increase in its mechanical advantage, and a further reduction in the pressing force required to snap-fit the assembled closure assembly 10, 40 to the container neck 50.

The radially inwardly extending protrusion 62 may also hold the distal end portion 56 of the radially outer wall in the radially inner position when the securing ring 22 is snap-fittingly engaged over and around the mounting flange 48 of the foldable pouring spout 40. For example, as shown in the illustrative drawings (see e.g. FIG. 11), the distal end portion 56 may be molded in the radially outer position, for ease of extracting the foldable pouring spout 40 from the mold tool (not shown). Being an integral part of the foldable pouring spout 40, the distal end portion 56 is formed from a relatively soft and flexible material. The typically stiffer and more robust securing ring 22 and its inwardly radially extending protrusion 62 are thus able to circumferentially compress the distal end portion 56, hinging it about the central flexure zone 58. The distal end portion 56 of the radially outer wall is thereby retained in the radially inner position when the securing ring 22 is snap-fittingly engaged over and around the mounting flange 48 (see e.g., FIG. 12). This also serves to hold the distal end portion 56 firmly engaged in the annular undercut 60 in the radially outer surface of the container neck 50 when the closure assembly 10, 40 is snap-fitted as a unit onto the container neck (see e.g., FIGS. 15 and 16). Alternatively, the distal end portion 56 of the radially outer wall may be molded in the radially inner position. The flexibility of the pouring spout material and the central flexure zone 58 then allow the distal end portion to circumferentially expand, hinging about the central flexure zone 58, so that the pouring spout 40 can be stripped from the mold tool. Then when the foldable pouring spout 40 is snap-fitted into the closure and securing ring molding 10, the distal end portion of the radially outer wall will be in its relaxed, radially inner position. In this case the stiffer and more robust retaining ring 22 and its inwardly radially extending protrusion 62 will again serve to hold the distal end portion 56 of the radially outer wall firmly engaged in the annular undercut 60 in the radially outer surface of the container neck 50 when the closure assembly 10, 40 is snap-fitted as a unit onto the container neck 50. In all cases the snap-fit engagement between the closure assembly 10, 40 and the container neck 50 may therefore be sufficiently firm that the closure assembly 10, 40 is very difficult or impossible to pry off the container neck 50 without showing visible damage.

With the securing ring 22 snap-fittingly engaged over and around the mounting flange 48, co-operating surfaces of the radially inwardly extending protrusion 62 and the distal end portion 56 of the radially outer wall may be configured to contact each other at a generally annular region 76 (FIG. 12*a*) that lies axially inward, toward the first end 42 of the foldable pouring spout 40, relative to an annular region 78 of the radially outer wall that makes initial contact with the container neck 50 as the container closure assembly 10, 40 is pushed onto it. This allows the distal end portion 56 of the radially outer wall to act as a lever which can provide a mechanical advantage for expanding the securing ring 22, thereby reducing the force required to snap the container closure assembly 10, 40 onto the container neck 50.

With the securing ring 22 snap-fittingly engaged over and around the mounting flange 48, co-operating surfaces of the radially inwardly extending protrusion 62 and the distal end portion 56 of the radially outer wall may be configured to contact each other at the generally annular region 76, wherein one or both of the co-operating surfaces is curved in radial cross-section, so as to provide at least a degree of rolling contact therebetween as the container closure assembly is snapped onto the container neck. The rolling contact may serve to reduce frictional forces, and hence the force required to snap the container closure assembly 10, 40 onto the container neck 50. In the illustrative example shown in the drawings, the contact surface of the distal end portion 56 is substantially straight (frustoconical) and the cooperating contact surface of the radially inwardly extending protrusion 62 is convexly curved. However other arrangements are possible which also provide suitable rolling contact. For example, the distal end portion 56's contact surface may be slightly concave; or the protrusion 62's contact surface may be straight or slightly concave, with the distal end portion 56's contact surface more convex.

With the container closure assembly 10, 40 snapped onto the container neck 50, the securing ring 22 may be configured to provide an enhanced interference fit between the container neck 50 and an annular sealing land within the mounting flange's circumferential groove 52. For example, the securing ring 22 may press the typically softer and more flexible proximal portion 54 of the circumferential groove's outer wall radially inwards. An annular sealing land 80 (FIG. 12*a*) on the inner surface of the outer wall proximal end 54 is thereby pressed against a protruding upper rim of the container neck 50 formed above the annular undercut 60. The stiffer material of the retaining ring 22 may also add creep resistance to the sealing land 80 and more generally to the outer wall of the mounting flange's circumferential groove 52.

With the container closure assembly 10, 40 snapped onto the container neck 50, the radially outer wall's distal end portion 56 and central flexure zone 58 and the radially inwardly extending protrusion 62 of the securing ring 22 may be configured to press an annular sealing land within the mounting flange's circumferential groove 52 into tighter sealing engagement with the container neck 50. For example, as the distal end portion 56 is pivoted by the protrusion 62 inwardly and upwardly on the central flexure zone 58 into the neck annular undercut region 60, annular sealing land 80 on the inner surface of the flange 48's outer wall may constrict against the protruding upper rim of the container neck 50 formed above the annular undercut 60.

At its axial side opposite to the first end 42 of the pouring spout 40 when snap-fitted over and around the mounting flange 48, the securing ring 22 may comprise an annular tamper-evidencing lip 82 (best seen in FIG. 12*a*) of reduced thickness. The tamper-evidencing lip 82 may be designed to be visibly damaged if an attempt is made to insert a pry-off tool between the securing ring 22 and the lid or body of the container, e.g., with the aim of prying the closure assembly 10, 40 off the container neck 50.

Figure 17:
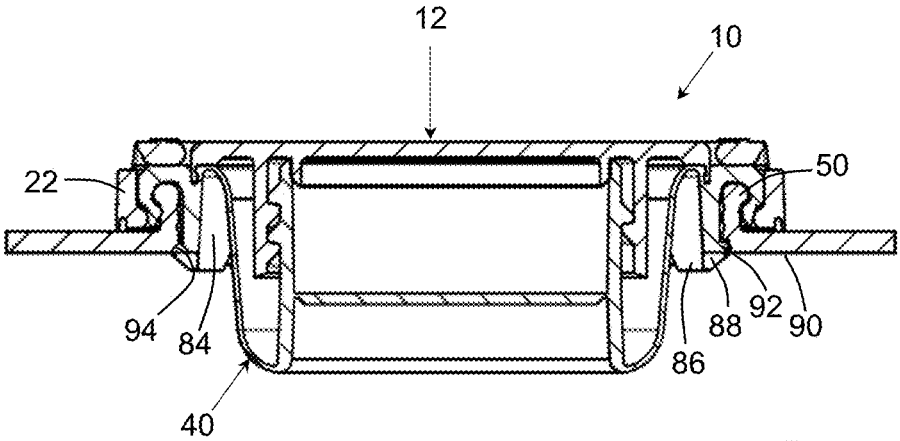
FIGS. 17 and 18 are cross-sectional views corresponding to FIG. 16, but showing respective alternative embodiments.
Figure 18:
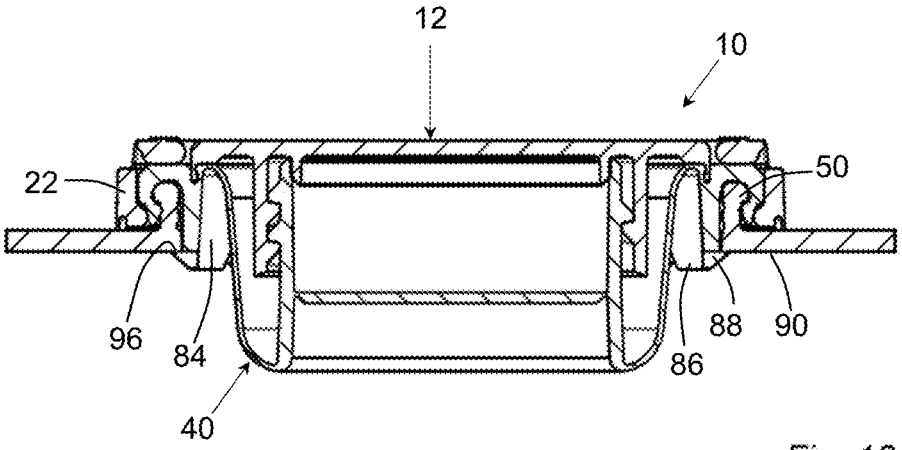

The circumferentially extending, axially open groove 52 of the mounting flange 48 may be defined in part by a radially inner wall 84 configured to extend through the container neck 50 when the container closure assembly 10, 40 has been snap-fitted onto the container neck. A distal portion 86 of the radially inner wall 84 may be configured to then extend axially inwardly beyond the container neck. The inner wall distal portion 86 may be radially apertured so that the container contents may be fully drained through the container neck by inversion of the container, without pooling around the inner wall distal portion. For this purpose, the illustrated example has drainage apertures in the form of V-shaped notches 88 in the radially inner wall distal portion 86, extending to the level of the inner surface 90 of the container wall adjacent to the neck 50. The apertures/notches 88 are distributed about the circumference of the radially inner wall 84, so as to provide a series of radially extending drainage channels. However, the detailed form of the drainage apertures is not critical—many other forms will be readily apparent, which allow substantially complete drainage of the container contents through the container neck 50 when the container is inverted. For example, some or all of the drainage apertures 88 may extend generally radially through the distal portion 86 of the radially inner wall 84 with a closed periphery, rather than having an open side ("holes", not "channels"). To assist in securing the container closure assembly 10, 40 to the container neck 50, the radially inner wall distal portion 86 may comprise a radially outer bead, an example of which is illustrated in FIG. 17 and indicated by the reference sign 92. The outer bead 92 is shown engaged in a circumferential notch or rebate 94 of complementary profile, formed around the inner entrance to the container neck 50. The outer bead 92 is therefore circumferentially continuous at this transverse plane, whereby the drainage apertures 88 do not directly reduce the circumferential stiffness of the outer bead 92 at this locale; making the outer bead 92 and inner wall 84 more effective in helping to snap-fittingly retain the container closure assembly 10, 40 on the container neck 50. FIG. 18 shows a further modification in which the circumferential rebate is absent and the profile of the outer bead (referenced 96) is correspondingly reduced. Therefore the drainage apertures 88 extend through the entire cross-section of the outer bead 96, but no modification of the standard container/container lid mold tools is required. Other things being equal, the outer bead 96 is likely to have a lower circumferential stiffness than the outer bead 92; but will still provide improved closure assembly retention compared to no bead at all. Other measures can be taken to increase the circumferential stiffness of the outer bead 96 while maintaining its compatibility with standard, rebate-less, container necks and maintaining the closure assembly's full drainage capability. For example, the drainage apertures 88 may still extend generally radially through the distal portion 86 of the radially inner wall 84 (including through the outer bead), but at least some of them may have a closed periphery, rather than an open side ("holes", not "channels").

What is claimed is:

1. A container closure assembly comprising:

a foldable pouring spout of plastics material having a first end providing a dispensing aperture and a second end provided with an annular mounting flange configured for mounting the foldable pouring spout on a container neck; and a closure member of plastics material removably sealingly engageable across the dispensing aperture to selectively allow or prevent dispensing of container contents through the dispensing aperture;

wherein the closure member is integrally formed with a securing ring which is attached to the closure member by a frangible connection;

the securing ring being snap-fittingly engageable over and around the mounting flange with the frangible connection intact and the thus assembled closure assembly being snap-fittingly engageable over and around the container neck;

a groove extending circumferentially about the annular mounting flange and which is open in an axial direction opposite to the first end of the foldable pouring spout for reception of the container neck in such snap-fitting engagement;

wherein the circumferentially extending, axially open groove is defined in part by a radially outer wall having a proximal portion lying towards the first end of the foldable pouring spout and a distal end portion lying away from the first end of the foldable pouring spout;

the radially outer wall comprising a central flexure zone of reduced radial width relative to the proximal and distal end portions and which interconnects the proximal and the distal end portions, whereby the distal end portion is hingeingly deflectable relative to the proximal portion, between a radially outer position for extraction of the foldable pouring spout from a mold tool, and a radially inner position for engagement in an annular undercut in a radially outer surface of the container neck;

wherein when the securing ring is snap-fittingly engaged over and around the mounting flange, the distal end portion is held in the radially inner position;

and wherein the distal end portion of the radially outer wall comprises a chamfer at its radially inner side and which extends radially inwards towards the first end of the foldable pouring spout for guiding the closure assembly into snap-fitting engagement with the container neck.

2. The container closure assembly of claim 1, wherein the distal end portion is elongated in axial cross-section.

3. The container closure assembly of claim 1, wherein a first axial end of the securing ring is connected to the closure member by the frangible connection.

4. The container closure assembly of claim 3, wherein the frangible connection comprises a plurality of frangible bridges distributed at intervals around a circumference of the securing ring.

5. The container closure assembly of claim 3, wherein the frangible connection comprises a rupturable membrane.

6. The container closure assembly of claim 1, wherein an axial end of the securing ring remote from the frangible connection defines an entrance through which the mounting flange passes as the securing ring is snap-fittingly engaged over and around the mounting flange; the entrance comprising a radially inwardly extending protrusion which provides the snap-fit engagement between the securing ring and the mounting flange.

7. The container closure assembly of claim 6, wherein a rim of a side of the mounting flange which faces towards the first end of the foldable pouring spout comprises a chamfer for guiding the mounting flange through the entrance and for compressing the mounting flange and/or expanding the securing ring as the mounting flange is pressed past the radially inwardly extending protrusion to provide the snap-fit engagement between the securing ring and the mounting flange.

8. The container closure assembly of claim 6, wherein a shoulder is formed at an end of the radially outer wall's proximal portion adjacent to the central flexure zone, and the radially inwardly extending protrusion is configured to engage behind this shoulder when the securing ring is snap-fittingly engaged over and around the mounting flange.

9. The container closure assembly of claim 6, wherein the radially inwardly extending protrusion holds the distal end portion of the radially outer wall in the radially inner position when the securing ring is snap-fittingly engaged over and around the mounting flange.

10. The container closure assembly of claim 6 wherein, with the securing ring snap-fittingly engaged over and around the mounting flange, co-operating surfaces of the radially inwardly extending protrusion and the distal end portion of the radially outer wall are configured to contact each other at a generally annular region that lies axially inward, toward the first end of the foldable pouring spout, relative to an annular region of the radially outer wall that makes initial contact with the container neck as the container closure assembly is pushed thereonto.

11. The container closure assembly of claim 6 wherein, with the securing ring snap-fittingly engaged over and around the mounting flange, co-operating surfaces of the radially inwardly extending protrusion and the distal end portion of the radially outer wall are configured to contact each other at a generally annular region, wherein one or both of the co-operating surfaces is curved in axial cross-section, so as to provide at least a degree of rolling contact therebetween as the container closure assembly is snapped onto the container neck.

12. The container closure assembly of claim 1 wherein, with the container closure assembly snapped onto the container neck, the securing ring is configured to provide an enhanced interference fit between the container neck and an annular sealing land within the mounting flange's circumferential groove.

13. The container closure assembly of claim 1 wherein, with the container closure assembly snapped onto the container neck, the radially outer wall's distal end portion and central flexure zone and the radially inwardly extending protrusion of the securing ring is configured to press an annular sealing land within the mounting flange's circumferential groove into tighter sealing engagement with the container neck.

14. The container closure assembly of claim 1 wherein, at its axial side opposite to the first end of the foldable pouring spout when snap-fitted over and around the mounting flange, the securing ring comprises an annular tamper-evidencing lip of reduced thickness.

15. The container closure assembly of claim 1 wherein, with the pouring spout in its folded position and the securing ring snap-fittingly engaged over and around the mounting flange, the closure member is configured to extend radially so as to cover the pouring spout from the mounting flange inward.

16. The container closure assembly of claim 15, wherein an annular sealing lip is provided on at least one of the pouring spout or closure member, which is engageable with the other of the closure member or pouring spout.

17. The container closure assembly of claim 1, wherein the circumferentially extending, axially open groove of the mounting flange is defined in part by a radially inner wall configured to extend through the container neck when the container closure assembly has been snap-fitted onto the container neck and a distal portion of the radially inner wall extends beyond the container neck and comprises a radially outer bead.

18. The container closure assembly of claim 17, wherein the inner wall distal portion is radially apertured so that the container contents may be substantially fully drained through the container neck by inversion of the container.

19. The container closure assembly of claim 1, wherein the closure member comprises at least one integrally formed, movably connected bail handle.

20. The container closure assembly of claim 19, wherein the bail handle comprises a lift tab received in a recess formed in the axial side of the securing ring adjacent to the pouring spout first end when the bail handle is in a stowed position; the lift tab then extending radially at least partly through the recess.

* * * * *